US005931214A

United States Patent [19]

Spicer et al.

[11] Patent Number: 5,931,214

[45] Date of Patent: Aug. 3, 1999

[54] MOLD HEATING VACUUM CASTING FURNACE

[75] Inventors: Robert A. Spicer, Willoughby Hills, Ohio; Allen R. Price, Whitehall, Mich.

[73] Assignee: Howmet Research Corporation, Whitehall, Mich.

[21] Appl. No.: 08/908,446

[22] Filed: Aug. 7, 1997

[51] Int. Cl.[6] ..... B22D 27/04

[52] U.S. Cl. ..... 164/258; 164/338.1; 164/122.1; 164/136; 164/348; 164/125; 164/127; 164/352; 164/361; 164/335

[58] Field of Search ..... 164/258, 256, 164/338.1, 122.1, 348, 125, 127, 352, 361, 136, 122.2, 335

[56] References Cited

U.S. PATENT DOCUMENTS

| | | | |
|---|---|---|---|
| 2,778,075 | 1/1957 | Huppert . | |
| 2,825,945 | 3/1958 | Ulrech et al. . | |
| 3,014,255 | 12/1961 | Bussard et al. . | |
| 3,260,505 | 7/1966 | Ver Snyder . | |
| 3,268,958 | 8/1966 | Sickbert . | |
| 3,410,332 | 11/1968 | Woodburn et al. . | |
| 3,532,155 | 10/1970 | Kane et al. . | |
| 3,601,179 | 8/1971 | Taylor . | |
| 3,614,976 | 10/1971 | Bolling et al. . | |
| 3,690,367 | 9/1972 | Daniels . | |
| 3,800,851 | 4/1974 | Coghill . | |
| 3,841,384 | 10/1974 | Tingquist et al. . | |
| 3,897,815 | 8/1975 | Smashey . | |
| 4,055,216 | 10/1977 | Leonidovich et al. . | |
| 4,436,485 | 3/1984 | Vonnegut | 164/122.1 |
| 4,813,470 | 3/1989 | Chiang . | |
| 4,850,419 | 7/1989 | Blazek | 164/122.1 |
| 5,046,547 | 9/1991 | Oti . | |
| 5,168,916 | 12/1992 | Doriath et al. | 164/338.1 |
| 5,259,441 | 11/1993 | Staub . | |
| 5,261,480 | 11/1993 | Wortmann et al. . | |
| 5,335,711 | 8/1994 | Paine . | |
| 5,503,215 | 4/1996 | Betz et al. | 164/258 |

*Primary Examiner*—Harold Pyon
*Assistant Examiner*—I.-H. Lin
*Attorney, Agent, or Firm*—Edward J. Timmer

[57] ABSTRACT

Mold heating vacuum casting furnace system comprising a mold preheating chamber located above and connected to a vacuum casting chamber via an intermediate isolation valve. A mold elevator is provided in the casting chamber and can be moved into the mold preheating chamber to lower the mold onto an annular rotary chill member residing in the casting chamber. The elevator includes an upstanding elevator shaft that moves in the opening of the annular chill member in a manner that the preheated mold is deposited or set on the annular chill member as the elevator is lowered into the casting chamber. The chill member includes an upwardly diverging mold engaging surface onto which the preheated mold is set by the elevator as it is lowered. The chill member is disposed on a turntable such that the turntable and melt-filled mold residing thereon can be rotated in stop/start manner to form equiaxed grain structure in a hub region of the casting following solidificatin of columnar grain airfoils by cooperation between the chill member and mold.

12 Claims, 2 Drawing Sheets

MOLD HEATING VACUUM CASTING FURNACE

FIELD OF THE INVENTION

The present invention relates to a mold heating vacuum casting system and method for making directionally solidified castings, especially castings having different grain structures at different regions of the castings, such as integral gas turbine wheels having an equiaxed hub and columnar grain airfoils extending from the hub.

BACKGROUND OF THE INVENTION

The casting of integral gas turbine wheels having an equiaxed grain hub and directionally solidified columnar grain airfoils is described in U.S. Pat. No. 4 813 470. This patent describes a casting furnace having an annular chill that cooperates with a ceramic investment mold to form the columnar grain airfoils. Vibrators are provided proximate the central hub-forming region of the melt-filled investment mold to vibrate the mold in a manner that forms the equiaxed grain structure at the hub region of the cast turbine wheel.

Past practice in the casting of gas turbine wheels has involved preheating the ceramic investment mold in a mold heating furnace. The preheated mold then is moved by a mold handling mechanism (either manually or by assisted method), in ambient air, to a casting furnace. The furnace has a crucible that provides molten metal for casting under vacuum into the preheated mold and a chill that cooperates with the mold, thus forming columnar grain airfoils that solidify first in the mold followed by the equiaxed grain hub. This practice is disadvantageous in that considerable heat is lost from the preheated mold during transport from the the mold heating furnace to the casting furnace. This also makes mold handling difficult due to the high mold temperature typically used; and the necessity to accurately place the mold onto the chill.

An object of the present invention is to provide a mold heating vacuum casting furnace and method of casting that overcome these disadvantages.

SUMMARY OF THE INVENTION

The present invention provides a mold heating vacuum casting furnace system and method wherein a mold preheating chamber is located above and connected to a vacuum casting chamber via an optional isolation valve. A mold elevator is provided in the casting chamber and is operated to lower the mold from the mold heating chamber onto an annular rotary chill ring member that resides in the casting chamber. To this end, the elevator includes an upstanding elevator shaft that moves through the opening of the annular chill member in the casting chamber in a manner that the preheated mold is deposited or set on the chill member as the elevator is lowered into the casting chamber.

The chill member includes a mold engaging surface onto which the preheated mold is positioned by the elevator as it is lowered. The elevator preferably is lowered until the mold is supported only by the annular chill member in the casting chamber and thermally isolated at the central region of the mold.

The chill member is connected to a turntable such that the turntable and melt-filled mold residing thereon can be rotated in stop/start manner that agitates the melt sufficiently thus forming the equiaxed grain structure in a hub region of the casting following solidification of columnar grain airfoils.

The present invention is advantageous by providing improved control of casting parameters such as mold preheat temperature, chamber vacuum levels, process cycle time, mold sealing, and mold alignment. Morever, the invention can provide improved control of solidification of the melt at the central hub region of the casting by virtue of use of the annular rotary chill ring member.

The above objects and advantages of the present invention will become better understood by reference to the following detailed description when considered in conjunction with the accompanying drawings.

DETAILED DESCRIPTION OF THE INVENTION

Figure 1:
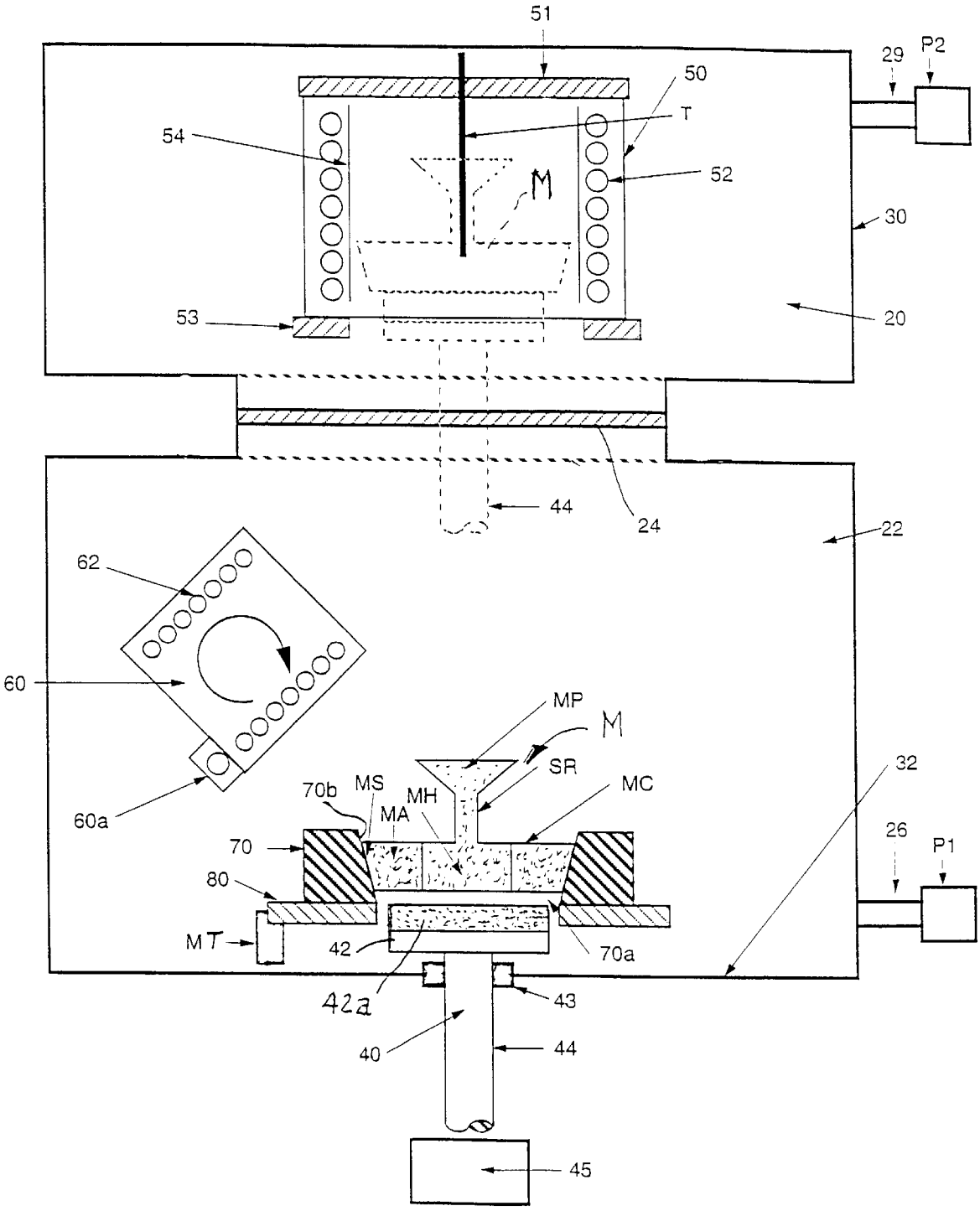
FIG. 1 is a schematic illustration of a mold heating vacuum casting furnace system in accordance with an illustrative embodiment of the invention wherein the preheated mold is lowered from a mold heating furnace to the casting chamber where the preheated mold is set on an annular chill ring member.
Figure 2:
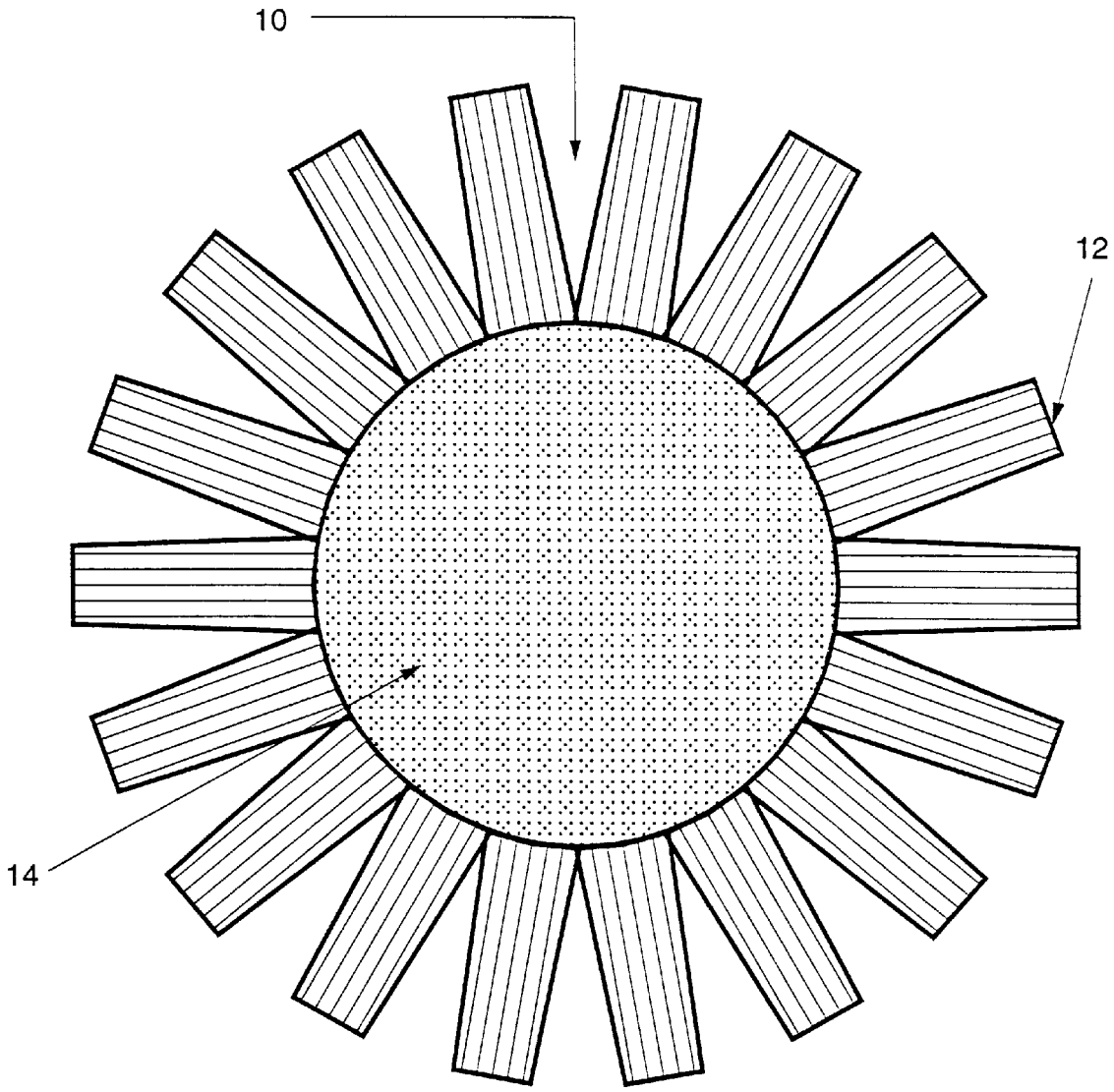
FIG. 2 is a plan view of a representative gas turbine engine wheel having a plurality of colmunar grain airfoils extending radially from a central equiaxed grain hub.

Referring to FIG. 1, a mold heating vacuum casting furnace system pursuant to one embodiment of the present invention is schematically illustrated for making an integral gas turbine wheel 10, FIG. 2, having a plurality of directionally solidified columnar grain airfoils 12 extending radially and integrally from a central equiaxed grain disc or hub 14. The airfoils 12 are spaced circumferentially about the disc or hub 14. The hub 14 is adapted to be mounted on a rotary engine shaft (not shown) as is well known.

The mold heating vacuum casting furnace system is shown comprising a mold preheating chamber 20 located above a vacuum casting chamber 22. The mold heating chamber 20 is defined within an upper housing 30 and the casting chamber 22 is defined within a lower housing 32 to this end. The mold heating chamber 20 can be communicated to the casting chamber 22 by a movable isolation valve 24 disposed between the chambers 20, 22. The valve 24 comprises a sliding gate or butterfly type of valve that is movable by a conventional fluid (e.g. pneumatic or hydraulic) cylinder or an electric solenoid (not shown) between a closed position isolating the chambers 20,22 from one another and an open position where the chambers 20,22 are in communication.

The casting chamber 22 includes a conduit or connection 26 to a vacuum pump P1 so that the casting chamber 22 can be evacuated during casting of a melt in the mold M. For example, the casting chamber 22 can be evacuated to less than 1 micron during the casting of a nickel or cobalt superalloys in the mold M.

The mold heating chamber 20 may optionally include a conduit or connection 29 to a vacuum pump P2 so that the mold heating chamber 20 can be independently evacuated during heating of the mold M. For example, the mold heating chamber 20 can be evacuated to less than 1 micron during preheating of a mold M prior to movement of the mold M from the mold heating chamber to the casting chamber.

The mold M can comprise a conventional ceramic investment shell mold formed by the lost wax technique wherein a wax pattern of a pour cup, runner or sprue, and the gas turbine wheel is invested in ceramic slurry and ceramic stucco to build up a plurality of ceramic layers on the pattern, which layers collectively form a shell mold. The pattern then is removed from the green shell mold by melting, dissolving or other known pattern removal technique, and the mold free of the pattern is fired at a suitable elevated mold firing temperature to impart sufficient strength to the mold for casting. The mold M includes a typical pour cup MP connected to the turbine wheel molding cavity MC by a runner or sprue SR. The mold cavity includes a central hub-forming mold cavity region MH and a plurality of outer, radially extending and circumferentialy spaced apart airfoil-forming mold cavity regions MA.

The fired investment shell mold M is positioned in the casting chamber 22 on thermal insulation member 42*a* (e.g. a ceramic plate member) on the top plate 42 of an elevator 40 that moves upwardly or downwardly in the casting chamber 22. The lower housing 32 includes a suitable sealable door (not shown) that can be opened to allow placement of the fired mold on the elevator table 42. The door then is vacuum tight sealed relative to the lower housing 32.

The elevator 40 includes the thermal insulation member 42*a* mounted on the top plate 42 of upstanding elevator shaft 44 that extends through a seal 43 disposed in the bottom wall 32*a* of the lower housing 32 to an elevator actuator 45. The actuator 45 can comprise a conventional fluid (e.g. pneumatic or hydraulic) actuator, screwtype actuator or other actuator for raising and lowering the elevator shaft 44 and thus the fired mold M thereon.

The fired mold M residing on the elevator table 42 initially is raised upwardly into a mold heating furnace 50 located in the mold heating chamber 20 as shown in dashed lines in FIG. 1 with the isolation valve 24 open. Once positioned in the mold heating furnace 50, the mold M is preheated to a suitable casting temperature by energization of induction coils 52 and a graphite susceptor 54 disposed in the furnace 50 about the mold M. Alternately, the furnace 50 can include electrical resistance heating coils (not shown) to heat the mold M. A typical mold preheating temperature for casting a nickel or cobalt superalloy can be in the range of 1200 to 2500 degrees F. A thermocouple T is provided in chamber 20 to extend into the mold M as shown to monitor the mold temperature.

The mold heating furnace 50 includes an upper heat baffle 51 and lower annular baffle 53, the baffles being made of graphite, alumina, zirconia or other insulative material, to provide more uniform heating of the mold M in the furnace 50. The inner diameter of the lower baffle 53 is slightly greater than the largest outer diameter of the mold M to allow the mold to pass therethrough with only a small gap (e.g. ½–2 inches) to reduce heat loss from the furnace 50.

Prior to preheating of the mold M, the casting chamber 22 is evacuated by pump P1 such that the mold heating chamber 20 communicated thereto via the open isolation valve 24 also is evacuated to the same extent.

After the mold M is heated to the casting temperature, the elevator 40 is lowered with the mold M on table 42 to transport the preheated mold directly from the mold heating furnace 50 to the casting chamber 22, FIG. 1.

Following transport of the preheated mold M into the casting chamber 22, the isolation valve 24 is closed to isolate the mold heating chamber 20 from the casting chamber 22 while a charge of metal or alloy; e.g. nickel or cobalt base superalloy charge, is melted in a crucible 60 disposed in the casting chamber. The crucible 60 includes induction coils 62 that are energized to melt the charge in the crucible. The crucible is made of a ceramic material, or includes a ceramic crucible lining, that does not react adversely with the chosen melt to be cast. For example, the crucible can comprise a zirconium bearing ceramic when a nickel or cobalt base superalloy charge is melted for casting into mold M.

The crucible 60 is mounted, for example, on crucible trunnions 60*a* in order to be tilted by a manual or automated tilting mechanism (not shown) in the casting chamber 22 to pour the melt from the crucible into the pour cup MP of the preheated mold M that is set on an annular rotary chill ring or member 70 in the casting chamber 22 as the elevator 40 is lowered therein, FIG. 1.

The annular rotary chill member 70 disposed in the casting chamber 22 defines a central chill opening 70*a* that is concentric relative to the longitudinal axis of the elevator shaft 44. The elevator shaft 44 extends and moves upwardly and downwardly through the chill opening 70*a* as is apparent from FIG. 1.

The chill member 70 typically comprises a high thermal conductivity material, such as copper. The chill member 70 may have a hollow interior for holding a reservoir of cooling fluid, such as water or a phase transformation material that achieves cooling by phase change, with a large enough cooling capacity to effect unidirectinal heat removal from airfoil-forming mold cavity regions MA as described below. Alternately, the chill member may include circumferential or other water cooling passages therein (not shown). Cooling water can be circulated through the cooling passages of chill member 70 by suitable rotating adaptors or quick disconnect fittings (not shown) connected to a water source.

The mold elevator 40 is movable through the chill opening 70*a* of the chill member to lower the preheated mold M to position outer peripherial surfaces MS of the airfoil-forming mold cavity regions MA in cooperating engagement with the inner peripheral surface 70*b* of the chill member 70, FIG. 1. In particular, the mold elevator 40 is moved downwardly to place the outer peripheral surfaces MS on the inner upwardly diverging or tapered chill surface 70*b*. The mold elevator 40 preferably is moved downwardly to an extent to disengage from the central hub-forming region MH of the mold M as also shown in FIG. 1 to thermally isolate the hub-forming mold cavity region MH, thereby leaving the mold M supported only on the upwardly diverging inner chill surface 70*b*.

The outer peripheral surfaces MS of the airfoil-forming mold cavity regions MA each include an open end that cooperates with the proximate inner chill surface 70*b* to close off the mold cavity regions MA in a manner that melt in the regions MP will contact the proximate chill surface 70*b* to provide unidirectional heat removal from the melt in each airfoil-forming mold cavity region MA to thereby form solidified airfoils having a columnar grain structure.

The chill member 70 is carried on an annular rotary turntable 80 disposed in the casting chamber 22. The turntable comprises a thermally conductive material, such as copper or steel. The turntable is rotated by a conventional electrical or fluid (e.g. pneumatic or hydraulic) drive motor MT so that the mold M can be rotated in stop/start manner to agitate the melt in the hub-forming mold cavity region MH sufficiently to form an equiaxed grain structure there.

In a method embodiment of the invention, the mold M disposed on the elevator table 42 is heated in the mold heating furnace 50 of the mold heating chamber 20. After the mold is heated to the selected mold preheat temperature, the preheated mold M is lowered on the elevator 40 from the mold heating furnace 50 directly into the casting chamber 22 with the elevator moving through the opening 70*a* of the chill member 70.

The elevator 40 is lowered in the casting chamber 22 to position the peripheral surfaces MS of the airfoil-forming mold cavity regions MA cooperatively engaged on the chill inner surface 70*b*. The isolation valve 24 then is closed.

While the mold is heated to casting temperature, a charge of selected metal or alloy is melted in the crucible 60 and is introduced as a melt into the preheated mold M disposed on the chill member 70 by pouring the melt in the mold pour cup MP. The melt in the airfoil-forming mold cavity regions MA is directionally solidified by virtue of unidirectional heat removal provided by the chill member 70 to form columnar grain solidified airfoils at mold regions MA. After the airfoils are solidified, the turntable 80 is rotated in stop/start manner to agitate the melt in the hub-forming regin MH sufficently to solidify as an equiaxed grain hub structure to thereby produce an integral turbine having an equiaxed grain hub and columnar grain airfoils.

The present invention is advantageous to provide improved control of casting parameters such as mold preheat temperature, chamber vacuum levels, process cycle time, mold/chill sealing, and mold/chill alignment. Morever, the invention can provide improved control of soldification of the melt at the central hub region of the casting by virtue of the rotary chill member.

While the invention has been described in terms of specific illustrative embodiments thereof, it is not intended to be limited thereto but rather only to the extent set forth hereafter in the following claims.

We claim:

1. Mold heating vacuum casting furnace system, comprising an upper mold heating chamber, a lower casting chamber disposed below and communicable to the mold heating chamber, an annular chill member disposed in the casting chamber and defining a central opening, a mold elevator disposed in the casting chamber and movable in the central opening in a manner to lower a mold heated in the mold heating chamber therefrom to the casting chamber onto the chill member with a mold peripheral region in cooperating engagement with the chill member and with a central region of the mold residing in the central opening of the chill member, means for introducing a melt into the preheated mold, said chill member removing heat from the melt to radially solidify the melt from said mold peripheral region toward said central region to form a columnar grain structure therebetween, and means for rotating the chill member with the mold peripheral region cooperatively engaged therewith after said columnar grain structure is formed so as to form an eguiaxed grain structure in the melt solidified in said central region.

2. The system of claim 1 wherein the chill member includes an upwardly diverging mold engaging surface for cooperatively engaging the mold peripheral region as the elevator is lowered in the casting chamber.

3. The system of claim 1 wherein the means for rotating the mold comprises an annular turntable on which the chill member is disposed and means for rotating the turntable and then stopping rotation thereof in repeated manner.

4. The system of claim 1 wherein the means for introducing the melt into the mold comprises a crucible in the casting chamber.

5. The system of claim 1 wherein the mold elevator includes an upstanding shaft and a table on which the preheated mold is disposed.

6. The system of claim 1 including an isolation valve between the chambers.

7. A method of making a casting having a central equiaxed grain region and a columnar grain region extending radially from the central region, comprising heating a casting mold disposed on a mold elevator in an upper mold heating chamber, lowering the preheated mold on the elevator from the mold heating chamber into a casting chamber disposed below the mold heating chamber and having an annular chill member therein with the elevator moving through an opening in the annular chill member to position a peripheral region of the preheated mold cooperatively with respect to the chill member and with a central region of the preheated mold residing in the opening in the annular chill member, introducing a melt into the preheated mold, directionally solidifying the melt radially from the peripheral mold region toward the central region to form a columnar grain structure therebetween, and rotating the chill member after the columnar grain structure is formed in a manner to solidify the melt at the central region of the mold with an equiaxed grain structure.

8. The method of claim 7 including lowering the elevator until the mold is unsupported at the central region and supported by the chill member at the peripheral region.

9. The method of claim 7 including contacting the melt in the peripheral region of the mold with the chill member.

10. The method of claim 7 including introducing the melt into the preheated mold after the mold peripheral region engages the chill member.

11. The method of claim 7 including rotating the mold after the melt solidifies in the periperhal mold region.

12. The method of claim 7 wherein said central equiaxed grain region comprises a hub of a gas turbine wheel and said columnar grain region comprises a plurality of airfoils extending from said hub.

* * * * *